US010889923B2

(12) United States Patent
Diaz et al.

(10) Patent No.: US 10,889,923 B2
(45) Date of Patent: Jan. 12, 2021

(54) KNIT APPAREL WITH INTEGRAL AIRFLOW AND STANDOFF ZONES

(71) Applicant: NIKE, Inc., Beaverton, OR (US)

(72) Inventors: Josue Diaz, Portland, OR (US); Andrea J. Staub, Portland, OR (US); Michael Tanios, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 15/821,028

(22) Filed: Nov. 22, 2017

(65) Prior Publication Data

US 2018/0142389 A1 May 24, 2018

Related U.S. Application Data

(60) Provisional application No. 62/426,198, filed on Nov. 23, 2016.

(51) Int. Cl.
*D04H 3/05* (2006.01)
*A41D 31/00* (2019.01)
(Continued)

(52) U.S. Cl.
CPC ..... *D04H 3/05* (2013.01); *A41D 27/28* (2013.01); *A41D 31/00* (2013.01); *A41D 31/102* (2019.02);
(Continued)

(58) Field of Classification Search
CPC . D04H 3/05; D04H 3/005; D04B 1/24; D04B 1/104; D04B 9/38; D04B 11/36;
(Continued)

(56) References Cited

U.S. PATENT DOCUMENTS 668,674 A * 2/1901 Brown ..... D04B 1/26 66/180
709,840 A * 9/1902 Williams ..... D04B 1/104 252/76

(Continued)

FOREIGN PATENT DOCUMENTS

CN 1120612 A 4/1996
CN 204812094 U 12/2015
EP 2937004 A1 10/2015

OTHER PUBLICATIONS

International Search Report and Written Opinion dated Mar. 5, 2018 in International Patent Application No. PCT/US2017/063030, 14 pages.

(Continued)

*Primary Examiner* — Danny Worrell
*Assistant Examiner* — Dakota Marin
(74) *Attorney, Agent, or Firm* — Shook, Hardy & Bacon, LLP

(57) ABSTRACT

Knit apparel formed using knitted structures and yarn content to create zonal venting and material standoff are provided. In aspects, garments having standoff structures knitted into one or more zones within the garment, on an internal and/or external surface of the garment, include tops and half-tights. The standoff structures are created using missed stitches with floats adjacent knitted stitches are integral to the surrounding material. Additionally, garments having airflow apertures are included, with transfer-stitch structures creating integral openings within the surrounding material.

17 Claims, 12 Drawing Sheets

(51) Int. Cl.

| | |
|---|---|
| ***A41D 27/28*** | (2006.01) |
| ***D04H 3/005*** | (2012.01) |
| ***A41D 31/102*** | (2019.01) |
| ***A41D 31/12*** | (2019.01) |
| *D04B 9/38* | (2006.01) |
| *D04B 11/36* | (2006.01) |
| *D04B 1/24* | (2006.01) |
| *D04B 1/10* | (2006.01) |
| *D04B 21/20* | (2006.01) |

(52) U.S. Cl.
CPC ..... *A41D 31/12* (2019.02); *D04H 3/005* (2013.01); *A41D 2500/10* (2013.01); *D04B 1/104* (2013.01); *D04B 1/24* (2013.01); *D04B 9/38* (2013.01); *D04B 11/36* (2013.01); *D04B 21/207* (2013.01)

(58) Field of Classification Search
CPC .... D04B 21/207; A41D 31/12; A41D 31/102; A41D 31/00; A41D 27/28; A41D 2500/10
USPC ..... 66/171, 172 E, 25, 40, 36, 215
See application file for complete search history.

(56) References Cited

U.S. PATENT DOCUMENTS 770,231 A * 9/1904 Gilbert ..... D04B 1/26 66/180
1,079,268 A * 11/1913 Scott ..... D04B 9/54 2/239
2,306,914 A * 12/1942 Smith, Jr. ..... D04B 9/54 66/172 E
2,313,332 A * 3/1943 Fregeolle ..... D04B 9/54 66/172 R
2,333,870 A * 11/1943 Lawson ..... D04B 1/18 66/172 E
2,349,746 A * 5/1944 Morris ..... D04B 1/26 66/172 E
2,380,768 A * 7/1945 Lawson ..... D04B 1/106 66/172 E
2,584,834 A * 2/1952 Bevins ..... A41B 3/00 66/176
2,585,597 A * 2/1952 St Pierre ..... D04B 1/26 66/172 R
2,731,819 A * 1/1956 Crawford ..... D04B 9/54 66/172 E
3,154,933 A * 11/1964 Holder ..... D04B 9/54 66/172 E
3,602,012 A * 8/1971 Burleson ..... A41B 11/12 450/111
3,906,753 A * 9/1975 Siegfried ..... A41B 11/00 66/170
3,924,423 A * 12/1975 Lonati ..... D04B 1/243 66/43
4,015,444 A * 4/1977 Johnson ..... D04B 1/06 66/42 R
4,109,492 A * 8/1978 Roberts ..... D04B 1/106 66/172 E
4,236,257 A * 12/1980 Williams ..... A41B 9/004 2/406
4,838,045 A * 6/1989 Cournoyer ..... D04B 1/104 66/196
4,941,331 A * 7/1990 Cournoyer ..... D04B 1/104 66/196
5,412,957 A * 5/1995 Bradberry ..... A61F 13/08 2/239
6,082,145 A * 7/2000 Lonati ..... A41C 3/0007 66/170
6,158,253 A * 12/2000 Svoboda ..... A41B 11/004 2/239
6,907,759 B2 * 6/2005 Sciacca ..... D04B 1/22 66/171
8,327,669 B2 * 12/2012 Weihermueller ..... D04B 1/106 66/172 E
2005/0204449 A1 9/2005 Baron et al.
2014/0366585 A1 12/2014 Shen et al.

OTHER PUBLICATIONS

International Preliminary Report on Patentability dated Jun. 6, 2019 in International Patent Application No. PCT/US2017/063030, 8 pages.

* cited by examiner

KNIT APPAREL WITH INTEGRAL AIRFLOW AND STANDOFF ZONES

CROSS-REFERENCE TO RELATED APPLICATIONS

This application having Ser. No. 15/821,028 and entitled "Knit Apparel with Integrated Airflow and Standoff Zones," claims the benefit of priority of U.S. Prov. App. No. 62/426,198, entitled "Circular-Knit Apparel with Integrated Airflow and Standoff Zones," and filed Nov. 23, 2016. The entirety of the aforementioned application is incorporated by reference herein.

TECHNICAL FIELD

Aspects herein relate to knit apparel formed using knitted structures and yarn content to create zonal venting and material standoff.

BACKGROUND

Zonal standoff nodes and zonal venting features have traditionally been created by applying post-processing material treatments or techniques that alter an already-knitted fabric.

BRIEF DESCRIPTION OF THE DRAWINGS

Examples of the present disclosure are described in detail below with reference to the attached drawing figures, wherein.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the disclosure or the claims. Rather, the claimed or disclosed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the scope. It will be understood that certain features and subcombinations are of utility and may be employed without reference to other features and subcombinations. This is contemplated by and is within the scope of the claims.

Aspects of the disclosure describe an article of apparel that is constructed with one or more knit textiles. The one or more knit textiles include characteristics, such as knit structures and yarn types, which at least partially contribute to features of the article of apparel. Examples of features to which the knit-textile characteristics may contribute include material features such as texture, loft, hand feel, weight, drape, and the like; aesthetic appearance; and material properties such as moisture wicking (the ability to move moisture from one face of the textile to a second opposite face of the textile), air permeability (the movement of air through the textile), breathability (the movement of moisture vapor through the textile), dry time, and the like.

Figure 1:
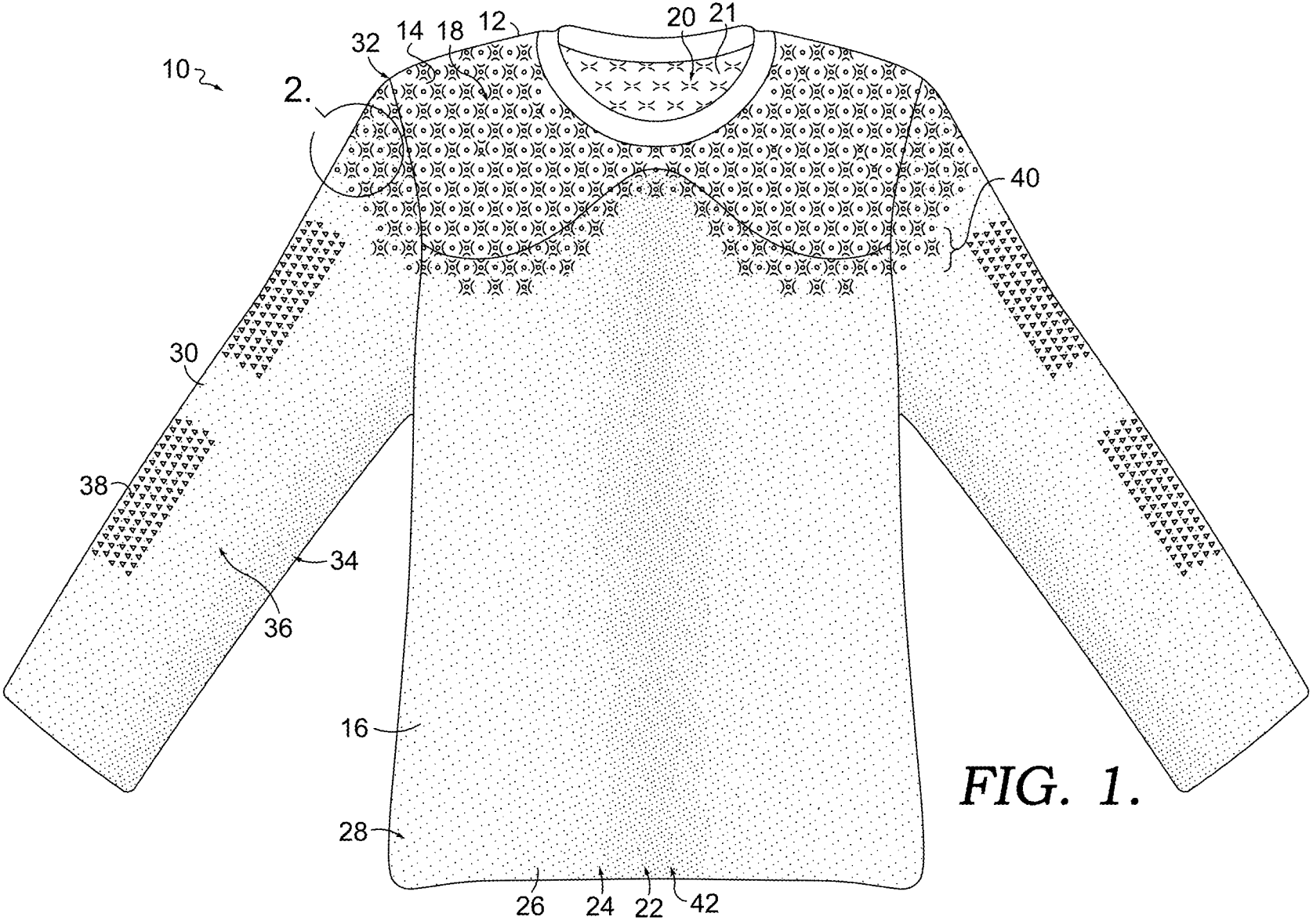
FIG. 1 illustrates a front view of an exemplary upper-torso garment having integrated standoff and airflow zones, in accordance with aspects herein.

Referring initially to FIG. 1, an exemplary article of apparel is depicted having knit-textile characteristics that contribute to features of the article, and the article in FIG. 1 is an upper-torso garment 10. In other aspects of the disclosure, the article may include a variety of types of articles. For example, the article may include other types of apparel, such as a lower-torso garment, footwear, a hat, gloves, socks, and the like. Moreover, the article may include other items, such as bags, athletic equipment, and upholstery. This list of articles is merely exemplary, and in other aspects of this disclosure, other types of articles not expressly listed may also include knit-textile characteristics described in this disclosure.

In one aspect of the disclosure, knit-textile characteristics that contribute to features of the article of apparel include one or more integrally knit structures. As used in this disclosure, an integrally knit structure includes a combination of one or more stitch types that collectively form a knit structure within a knit-textile panel and that share one or more yarn strands with the knit-textile panel. Examples of stitch types that may form an integrally knit structure include knit stitches, float stitches, tuck stitches, transfer stitches, drop stitches, interlocking stitches, missed-stitches, and the like. As explained above, an integrally knit structure may contribute to one or more features of the knit textile (e.g., material structure, material appearance, and material properties). Examples of integrally knit structures include nodes, apertures, protuberances, and the like, as will be described in greater detail in other portions of this disclosure.

Aspects of the present disclosure, including the upper-torso garment 10 of FIG. 1, may be formed by circular knitting. As used herein, the term "circular knitting" is meant to cover weft knitting machines that have needle beds arranged in circular cylinders of varying diameters. The machines may have a cylinder and dial arrangement and may comprise either a single or double cylinder. In some aspects, the garment body 12 of the upper-torso garment 10 is circular knit into a single piece to provide a seamless construction. In other aspects, a tubular structure is created via circular knitting, and one or more portions of the tubular structure are removed and secured together along one or more seams to create the garment body 12. For example, the garment body front 60, garment body back 68, and sleeve 72 in FIGS. 5-7 may be knitted separately as pattern pieces and coupled together to create the upper-torso garment 10. In alternative aspects, one or more pieces with the integrated standoff features and/or apertures may be constructed on a flat-knitting machine (single or double bed) with the one or more pieces being sewn together to form seams.

Integrally Knit Structures—Nodes

As described above, in an aspect of this disclosure, integrally knit structures contribute to one or more features of a knit textile, which may be used to construct an article (such as the upper-torso garment 10 in FIG. 1). One type of integrally knit structure includes an integrally knit node, and as used in this disclosure, a "node" refers to an integrally knit structure that protrudes a distance from a surface of the knit-textile panel. In an aspect of this disclosure, the distance by which a node protrudes from a surface of the knit-textile panel is within a range of distances. For example, in FIG. 1, the garment 10 includes a node 20 protruding from a surface 21 (e.g., an inner-facing surface of the upper-body garment 10), and additional depictions of an integrally knit node 54 protruding from a surface 53 are depicted in the magnified view of FIG. 3.

Figure 3:
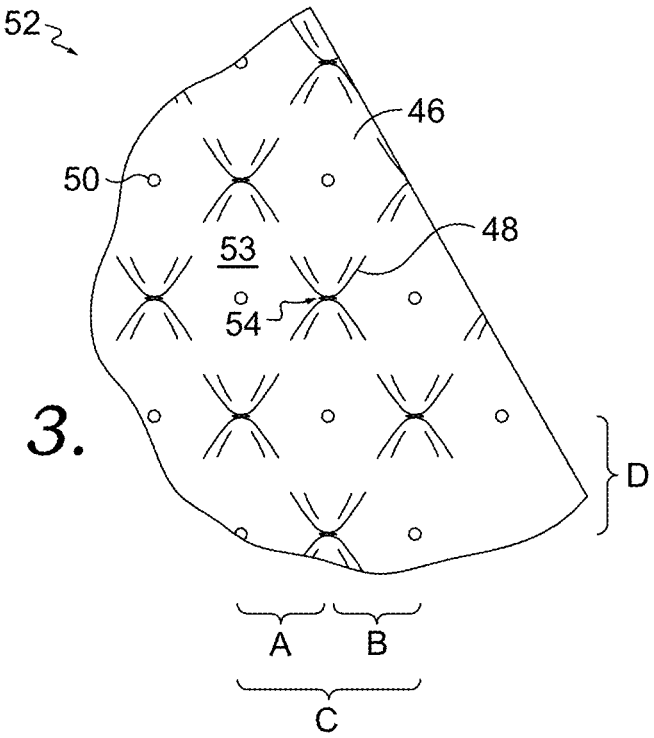
FIG. 3 illustrates an enlarged, back view of a portion of the integrated standoff zone of FIG. 1, in accordance with aspects herein.
Figure 15:
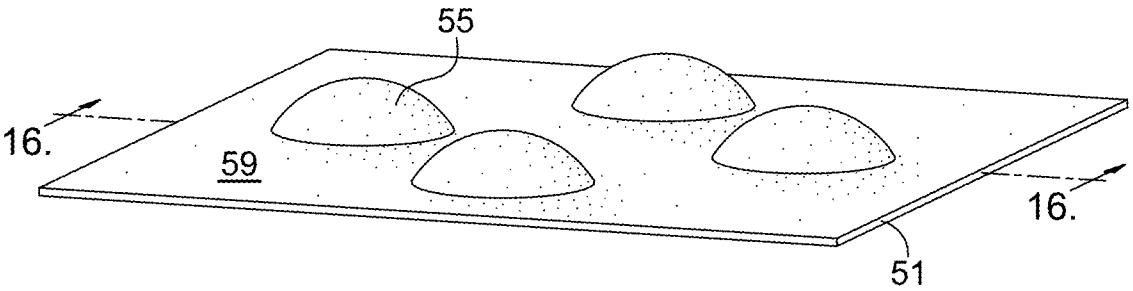
FIG. 15 includes a schematic representation of nodes, in accordance with an aspect of this disclosure.
Figure 16:
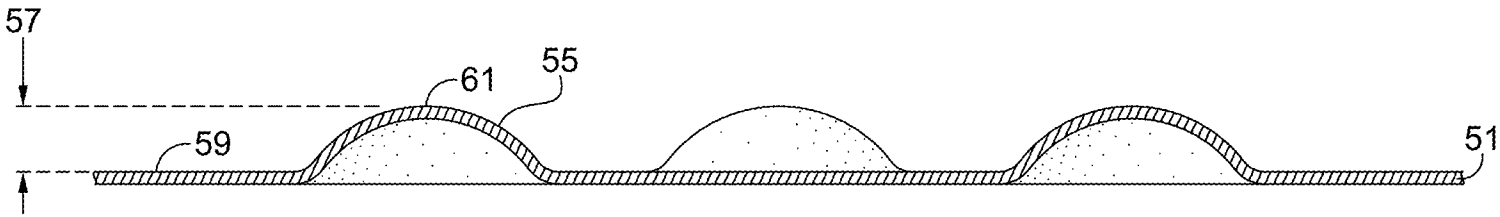
FIG. 16 includes a cross-sectional view taken from the 16-16 reference line in FIG. 15, in accordance with an aspect of this disclosure.

Reference is also made to FIGS. 15 and 16 to further explain and illustrate a manner in which a node protrudes a distance from a surface of a knit-textile panel. For example, FIGS. 15 and 16 provides a schematic depiction of a plurality of nodes, such as the node 55 that protrudes a distance 57 from a surface 59 of the knit-textile panel 51. As depicted in FIG. 16, the distance 57 includes a length between the surface 59 and a node endpoint 61. In an aspect of the present disclosure, the distance 57 is in a range of about 1 mm to about 6 mm. In another aspect of the present disclosure, the range is about 1.5 mm to about 4 mm. These ranges are merely exemplary of some aspects of the disclosure, and in other aspects, the distance 57 may be smaller than this range or larger than this range. In addition, the shape of the nodes depicted in FIGS. 15 and 16 is merely illustrative, and in other aspects, a node may include a variety of other shapes, such as rod, ovular, prismatic (e.g., triangular prism, square prism, rectangular prism, etc.), pyramidal (triangular pyramid, square pyramid, etc.), and organic with irregular boundaries. Likewise, the shape of the nodes (e.g., 54) may be star-shaped or x-shaped, as depicted in FIG. 3.

Figure 17:
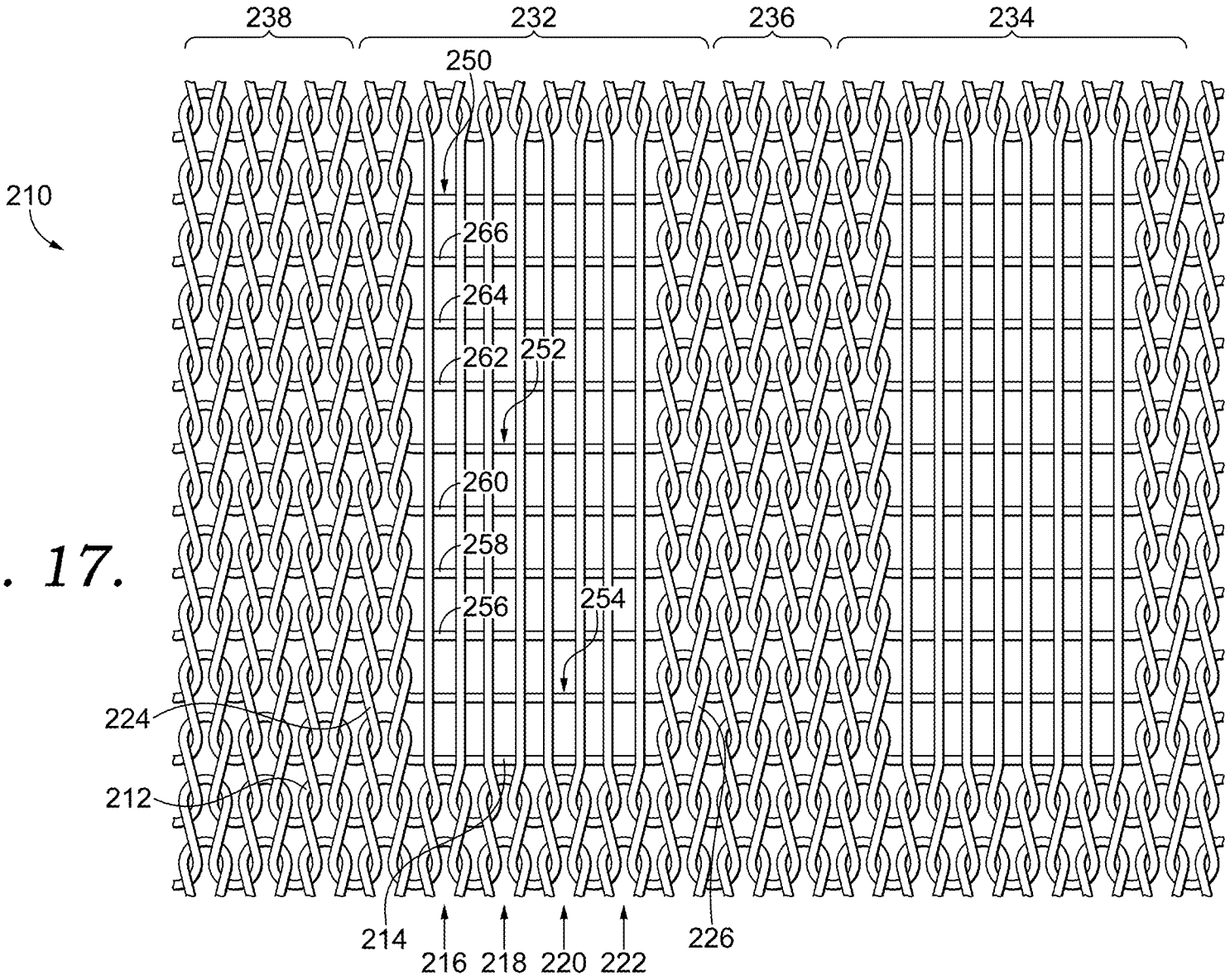
FIG. 17 includes a knit schematic, in accordance with an aspect of this disclosure.

A node may be constructed in various manners. For example, in one aspect of the present disclosure, a node is constructed of a combination of knit stitches and one or more miss stitches with floats. An exemplary knit schematic is depicted in FIG. 17, which illustratively depicts a knit-textile panel 210 having, among other things, a knit stitch 212 and a float 214. As depicted in FIG. 17, the face of the knit-textile panel is oriented toward the viewer (on the side facing the viewer) and the back of the knit-textile panel is oriented away from the viewer (on the side facing away from the viewer). A "miss stitch" refers to stitch omitted on the face side of a knit textile and results in a float extending along the back side. As used in this disclosure, a "float" refers to a yarn structure formed when one or more knitting needles are deactivated and do not move into position to accept the yarn at the appropriate sequence, such that the yarn strand merely extends along the back of the knit-textile panel and past knit stitches, such that no stitch is formed (resulting in the miss stitch omission on the front side). A float can have a variety of different lengths. For example, a float may only traverse a single stitch position (sometimes referred to as a single-needle miss), and in other aspects, a float may traverse multiple adjacent stitch positions. For example, if four adjacent stitch positions are consecutively missed, then the miss stitch may be identified as a four-needle miss and the resulting float may traverse the four consecutive stitch positions. This is illustrated in FIG. 17, by the float 214, which traverses four stitch positions 216, 218, 220, and 222. In this example, the float extends between and connects one knit stitch 224 directly adjacent to one side of the four consecutive stitch positions to another knit stitch 226 directly adjacent to the other side of the four consecutive stitch positions.

Various combinations of knit stitches and floats may construct a node that protrudes from a surface of a knit-textile panel. For example, in one aspect of the present disclosure, a node comprises at least one knit stitch, followed by a miss stitch having a float that traverses a number of stitch positions, followed by at least one additional knit stitch. In this example, the number of stitch positions traversed by the float may be in a range that includes at least one stitch position and less than fourteen stitch positions. In a further embodiment, the range is between three stitch positions and ten stitch positions. In yet another embodiment, the float traverses four stitch positions (i.e., four-needle miss) as depicted by FIG. 17. These ranges are merely exemplary of some aspects of the disclosure, and in other aspects, the float may traverse a larger number of stitch positions. For example, referring briefly to FIG. 13, a one-needle miss is represented by notation 126 and 128 in the knit diagram.

In a further aspect, a node is constructed by a sequence of stitches that repeats on a plurality of adjacent courses, the sequence including at least one first knit stitch, followed by a float traversing a number of stitch positions between one and fourteen, followed by at least one second knit stitch. For example, FIG. 17 includes a first stitch 224, followed by the float 214 traversing four stitch positions (i.e., between one and fourteen), followed by a second knit stitch 226. The sequence illustrated in FIG. 17 is repeated on ten adjacent courses in which the respective first knit stitch of each sequence is at the same needle position, and the respective second knit stitch of each sequence is at the same needle position. In other aspects of the present disclosure, the sequence may repeat on a number of courses in a range between five courses and twenty courses. This range is merely exemplary of some aspects of the disclosure, and in other aspects, the sequence may repeat on fewer than five adjacent courses or more than twenty adjacent courses.

In another aspect of the present disclosure, a node is formed by a plurality of repeating sequences that are positioned in the same set of courses as one another and are spaced apart by one or more knit stitches. For example, FIG. 17 includes a first repeating sequence 232 and a second repeating sequence 234 that are spaced apart by two wales 236 of stitches. The pair of repeating sequences 232 and 234 having the missed stitches and resulting floats may collectively contribute to a node that protrudes from a knit-textile panel. For example, the sequences 232 and 234, in combination with the knit wales 236 between the sequences 232 and 234, may collectively protrude in the direction of the floats, relative to the rest of the knit-textile panel. In other words, if the stitches that are depicted in the wales 238 represent a knit-textile panel, then the sequences 232 and 234, and the stitches in the wales 236 may protrude from the back side of the knit-textile panel 210. This protruding structure may result from various factors, including but not limited to, the relative stability and shortened length of the float yarn strand, as compared with the longer lengths of the knit-stitch yarn strands adjacent to the floats and the repeating sequences. In the exemplary depiction of FIG. 17, the sequences 232 and 234 both include floats that traverse four stitch positions, such that floats in both sequences are similar lengths. In other aspects of the disclosure, one sequence may include a float having a first length and the second sequence may include floats having a second length that is shorter or longer than the first length.

In a further aspect of the present disclosure, a yarn type or a combination of yarn types may also contribute to the protrusion of a node. For example, in one aspect, a relatively non-elastic yarn is positioned on the face of the knit-textile panel and a relatively elastic yarn is positioned on the back of the knit-textile panel. In this respect, the relative difference in elasticity of the face yarn and the back yarn may contribute to the protrusion of the node. In other aspects, a non-elastic yarn (also sometimes referred to as a non-stretch yarn) positioned on the face side, may include a stretch property that satisfies a measurable value. For example, a non-elastic yarn may include a maximum stretch of less than 200% under load prior to returning to a non-stretched state when the load is removed. In a further aspect, the non-elastic yarn provides a maximum stretch of less than 100%. Examples of non-elastic yarn types include nylon and polyester. In another example, an elastic yarn (also sometimes referred to as a stretch yarn) positioned on the back side, may include a stretch property that satisfies a measurable value. In general, elastic yarn types may provide a maximum stretch greater than 200% under load prior to returning to a non-stretched state when the load is removed, and some elastic yarns provide a maximum stretch of about 400%. Examples of elastic yarns include Spandex®, elastane, lycra, and the like.

With this as background, a knit-textile panel may include an outside polyester (poly) cationic dyeable (CD) yarn having 55 denier, 48 filament, and one-ply structure (55/48/1), and an inside poly CD yarn having 33 denier, 36 filament, one-ply structure (33/36/1). In further aspects, a knit textile may include poly CD 55/48/1 yarn on an outside, and poly CD 33/36/1+13D elastic yarn (a 13 denier elastic yarn wrapped with a 33 denier, 36 filament, 1 ply polyester yarn) on an inside portion of the material, such as in specific zones to create tension within the fabric, with the elastic yarn inserted adjacent the missed-stitch structures for creating nodes between the missed-stitch structures. In some aspects, the insertion of a 33/36/1+13D elastic yarn on an inside of a garment may generate further dimension and displacement proximate one or more integrated features, such as an integrated missed-stitch structure and/or integrated transfer-stitch structure.

In further aspects, a knit textile may include a poly CD 44/36/1 yarn on an outside, with a poly flat CD 22/24 yarn inside. Similarly, knit textile may include a poly CD 44/36/1 yarn on an outside, with a poly flat CD 22/24+13 D elastic yarn on the material inside, such as an elastic yarn inserted within specific zones to create nodes adjacent the missed-stitch structures. Additionally, in other aspects, a variety of different materials and yarn combinations may be used to vary the resulting fabric feel, dimension, properties, structure, appearance, and the like. As such, in one aspect the knit textile may include a poly flat CD 50/24 yarn on a face side, with a covered elastic yarn 20/30/18 on a back side. In some aspects, a proportion of denier, filament, ply, and/or elastic yarn content may be changed to adjust one or more characteristics of the garment material. For example, a yarn combination may be adjusted between airflow zones and standoff zones, and may further be altered within such zones, to provide a desired amount of standoff, ventilation, and other engineered characteristics within the zonal features of the knit material.

An elastic yarn may be integrally knit into a back side of a knit-textile panel in various amounts. For example, an elastic yarn may be knit into every course of the knit-textile panel. In addition, in an aspect of the present disclosure, the elastic yarn is intermittently knit into the back side of a knit-textile panel. For example, the elastic yarn may be knit into every other course, every third course, every fourth course, and the like. Accordingly, a knit panel may have a ratio of knit courses with elastic to knit courses without elastic. In one aspect the ratio is in a range of 1:1 to 1:8 of knit courses with elastic to knit courses without elastic. In yet another aspect, the range is 1:3, and referring to FIG. 17, the knit-textile panel would have a 1:3 ratio if courses 250, 252, and 254 include elastic yarn and courses 256, 258, 260, 262, 264, and 266 did not include elastic yarns. In one aspect, the ratio of 1:3 may at least partially contribute to an extent which the node protrudes from the knit-textile surface, while also balancing a weight and feel of the knit-textile panel resulting from the elastic yarn. This range is merely exemplary of some aspects of the disclosure, and in other aspects, the knit-textile panel may include elastic in every course or may include elastic in even fewer courses.

In a further aspect of the present disclosure, the protruding of a node from the back side is created at least in part by a combination of the pair of repeating sequences with the elastic yarn on the back side. For example, the elastic yarn in the floats may pull on the first and second knit stitches (e.g., 224 and 226), which may bias the repeating sequences into a plane that is different from the surrounding knit-textile panel.

In one aspect of the present disclosure, the back side of the knit-textile panel is oriented on an inside surface of a garment, such that the inside surface faces towards the garment wearer when the garment is in an as-worn configuration. In a further aspect, the integrally knit nodes protrude from the inside surface and space the knit-textile panel apart from the wearer's body surface when the garment is worn. Spacing the knit-textile panel apart from the wearer's body surface may create separation between portions of the garment and the wearer, and may contribute to increase airflow between the garment and the wearer and may also impede or decrease the garment from clinging to the wearer. As such, in this disclosure a node may also be referred to as a "standoff structure" because the node functions to space parts of the garment apart from the wearer (i.e., create separation between the wearer's skin and the knit-textile panel).

Some additional aspects of a garment having nodes will now be described with respect to FIGS. 1-3. Nodes may be integrally knit into a garment at various positions. For example, FIG. 1 depicts a front view of an exemplary upper torso garment 10, which includes a garment body 12 with an integrated standoff zone 14 and an integrated airflow zone 16. As used in this description, an "integrated standoff zone" describes a region of a garment in which a plurality of integrally knit nodes are constructed, and an "integrated airflow zone" describes a region of a garment in which a plurality of integrally knit holes or apertures are constructed. The integrated standoff zone 14 is oriented within a particular portion of the garment 10 (namely the chest and shoulder region of the garment 10), but may be positioned in another location and/or orientation in various aspects. Similarly, while the airflow zone 16 is generally positioned below and adjacent the standoff zone 14, it is also contemplated that a position of at least a portion of the airflow zone 16 may change, or that an amount of separation may occur between the standoff zone 14 and the airflow zone 16, in some aspects.

In the example of FIG. 1, the standoff zone 14 includes one or more standoff densities 18. As used in this description, a "standoff density" describes a number of nodes in a defined area of the garment. For example, a standoff density may describe a number of nodes in a defined square or rectangular array of stitches (e.g., 40 stitch/course×40 stitch/wale array, 100 stitch/course×50 stitch/wale array, etc.). In addition, a standoff density may be defined in relative terms based on a comparison between two different zones of the garment, such that one zone may have a higher standoff density than another zone. In general, a lower standoff density corresponds to a region in which nodes are smaller and/or spaced farther apart as compared with a higher standoff density. While the standoff density 18 is depicted in FIG. 1 as including a relatively consistent placement within the garment body 12, in some aspects, the standoff density 18 may include a gradient density, more staggered positioning, less staggered positioning, greater spacing, less spacing, and/or other alternative variable characteristics of the standoff density 18. In one example, the standoff density 18 may taper from a greater density proximate the airflow zone 16, to a decreased density proximate the top of the garment body 12.

As further depicted in FIG. 1, the standoff zone 14 includes an internal view of each node 20 formed next to one or more missed-stitch structures with resulting floats (e.g., FIG. 17). The orientation of such standoff nodes 20 may correspond, directly or indirectly, to one or more standoff features within the standoff zone 14. In another aspect, each standoff node 20 on an internal surface of the garment 10 corresponds to a particular missed-stitch structure on the face of the garment body 12.

Figure 2:
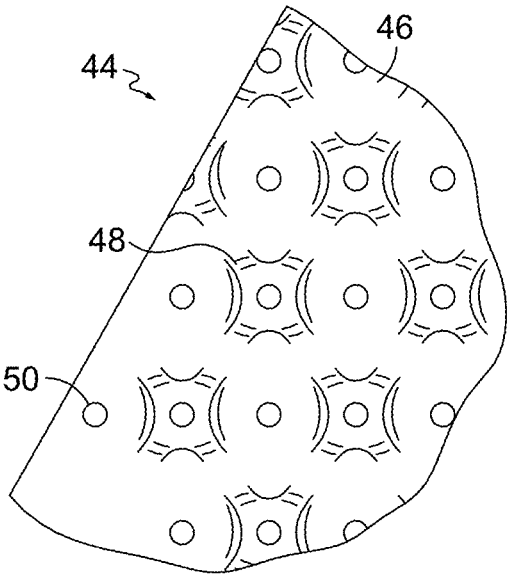
FIG. 2 illustrates an enlarged, front view of a portion of the integrated standoff zone of FIG. 1, in accordance with aspects herein.

In the enlarged aspect of FIG. 2, a standoff zone 44 may include a standoff zone material 46 (e.g., knit-textile panel) with external standoff structures 48 that are alternated with airflow apertures 50. In some aspects, at least one external standoff structure 48 corresponds to the internal view 52 of FIG. 3, having a series of standoff structures 48 that correspond to the internal standoff nodes 54 in FIG. 3. The position of such standoff structures 48, resulting standoff nodes 54, and intermediate airflow apertures 50, may change according to a particular garment implementing such zones.

Integrally Knit Structures—Apertures

As previously indicated, FIG. 1 depicts a front view of an exemplary upper torso garment 10 having a garment body 12 with an integrated standoff zone 14 and an integrated airflow zone 16. In general, the integrated standoff zone 14 is oriented within a particular portion of the garment 10, but may be positioned in another location and/or orientation in various aspects. Similarly, while the airflow zone 16 is generally positioned below and adjacent the standoff zone 14, it is also contemplated that a position of at least a portion of the airflow zone 16 may change, or that an amount of separation may occur between the standoff zone 14 and the airflow zone 16, in some aspects.

In exemplary aspects, the airflow zone 16 comprises ventilation structures in the form of a plurality of apertures. The apertures may be formed using transfer stitches within the knit structure. The transfer stitches may be executed using a single bed machine or a double bed machine (circular knit machine and/or flat knit machine). The apertures provide venting capabilities by allowing air to transfer from the exterior environment to the interior of the garment 10 to cool off a wearer's skin, and/or by allowing heated air to escape from the interior of the garment 10 to the exterior environment. In some aspects, apertures are formed using a one-needle hole transfer. Additionally, a two-needle hole transfer, and/or a three-needle hole transfer may be used to create larger apertures, which provide increased venting capabilities.

In exemplary aspects, the aperture density is varied in select portions of the garment 10 to provide zones with varying amounts of venting capabilities. As used herein, aperture density refers to the area of non-knitted regions created via apertures per an area of the garment. Higher aperture densities include greater concentrations of non-knitted regions and, as such, allow greater amount of air to transfer to the interior of the garment 10 for cooling off the wearer and/or allows greater amount of heated air to transfer out of the garment 10. In exemplary aspects, higher aperture densities result from larger apertures, such as apertures formed by a three-needle hole transfer. It is also contemplated, however, that higher aperture densities may be achieved through decreasing the spacing between apertures or a combination of decreased spacing and larger aperture size.

In exemplary aspects, areas of the upper-torso garment 10 configured to cover high-heat or sweat producing areas of a wearer's body (based on, for example, heat or sweat maps of the human body) have higher aperture densities. For instance, there may be a first aperture density zone 22 along a central midline of the garment body 12, a second aperture density zone 24 adjacent the first aperture density zone 22 on either side of the central midline, a third aperture density zone 26 adjacent the second aperture density zone 24, and a fourth aperture density zone 28 adjacent the third aperture density zone 26. Although aperture density zones 24-28 are labeled only on one side, it will be appreciated that each aperture density zone 24-28 is similarly located on the other side of the central first aperture density zone 22. Aperture density zones 22-28 may have different aperture densities to provide different degrees of venting, with the first aperture density zone 22 having the highest aperture density relative to the other zones 24-28.

In exemplary aspects, the density of apertures in the airflow zone 16 decreases from the first aperture density zone 22 out to the fourth aperture density zone 28. In this way, the apertures may be positioned in a density gradient in the airflow zone 16, with the highest density of apertures positioned in the midline of the garment body 12 and the lowest density of apertures positioned along the sides of the garment body 12, providing the greatest amounts of venting to a wearer's midline when the upper-torso garment 10 is worn. Although the exemplary airflow zone 16 includes a density gradient between the first, second, third, and fourth aperture density zones 22-28, it is understood that additional or alternative numbers of aperture density zones may be included within the airflow zone 16.

As previously mentioned, varying aperture densities may be achieved by changing the aperture size, the spacing between apertures, or a combination of both. As such, it will be understood that the dots in the aperture density zones 22-28 illustrated in FIG. 1 are intended to illustrate relative densities and, as such, are not necessarily representing each apertures. For example, at least some of the aperture density zones 22-28 in exemplary aspects of the upper-torso garment 10 have different aperture sizes to provide different degrees of airflow. In some aspects, the first aperture density zone 22 includes apertures formed by a series of three-needle hole transfers, while the second aperture density zone 24 includes smaller apertures formed by a series of two-needle hole transfers. The third aperture density zone 26 may be created using a series of one-needle hole transfers to provide apertures smaller than those formed in the second aperture density zone 24. The apertures in the fourth aperture density zone 28 may also be formed by a one-needle hole, but the apertures may be spaced apart at a greater distance than in the third aperture density zone 26 to achieve a lower aperture density.

Further, in some aspects, there may be areas of gradual transition between the different aperture density zones. The upper-torso garment 10 depicted in FIG. 1, for example, includes a blended boundary 42 between adjacent aperture density zones (first aperture density zone 22 and second aperture density zone 24). The blended boundary 42 is a region with an aperture density between the aperture densities in the first aperture density zone 22 and second aperture density zone 24. Blended boundary 45, for instance, may include some apertures formed by three-needle hole transfers and some apertures formed by two-needle hole transfers. While not specifically labeled, it is contemplated that there are similar blended boundaries between the second aperture density zone 24 and the third aperture density zone 26 and between the third aperture density zone 26 and the fourth aperture density zone 28.

Knit Textile Including Standoff Structures and Apertures

As shown in FIG. 1, exemplary aspects of the disclosure include both a standoff zone 14 to create separation between a wearer's body and the garment body 12, which provides anti-cling benefits, and an airflow zone 16 for air ventilation between the exterior environment and the interior of the garment 10. Further, at least a portion of each zone may overlap to achieve the benefits of both the standoff structures and apertures within the garment body 12. Front overlap zone 40 of FIG. 1, for instance, includes both standoff structures and apertures. Just as in the standoff zone 14 and the airflow zone 16, the density of the standoff structures and apertures, may be varied across the front overlap region 40 to provide different degrees of anti-cling and ventilation capabilities. Front overlap zone 40 may span across the chest region of the garment body 12 and into the shoulder regions of the sleeves 30.

An enlarged aspect of an exterior-facing side of the front overlap zone 40 is depicted in FIG. 2. As illustrated, there are a plurality of standoff structures 48 that are alternated with airflow apertures 50. FIG. 3 illustrates the interior-facing side of the front overlap zone 40, which includes standoff nodes created by the standoff structures 48 similarly alternating with the airflow apertures 50. In some aspects, the overlap zone 40 includes a 1:1 ratio of standoff nodes 48 and airflow apertures 50. In these aspects, there are a plurality of rows of alternating standoff nodes 48 and airflow apertures 50, with the rows being staggered such that columns of alternating standoff nodes 48 and apertures 50 are created. Accordingly, as shown in FIG. 3, a standoff node 48 may be spaced from an airflow aperture 50 on one side by spacing A and from another airflow aperture 50 by spacing B, while spacing C (which is spacing A plus spacing B) is the distance between two closest airflow apertures 50 in a row. Additionally, each row of alternating features may be separated by spacing D. The staggering, or offset, of the standoff nodes 48 and airflow apertures 50 creates an arrangement of optimal ventilation and optimal standoff with respect to the standoff zone material 46.

Figure 5:
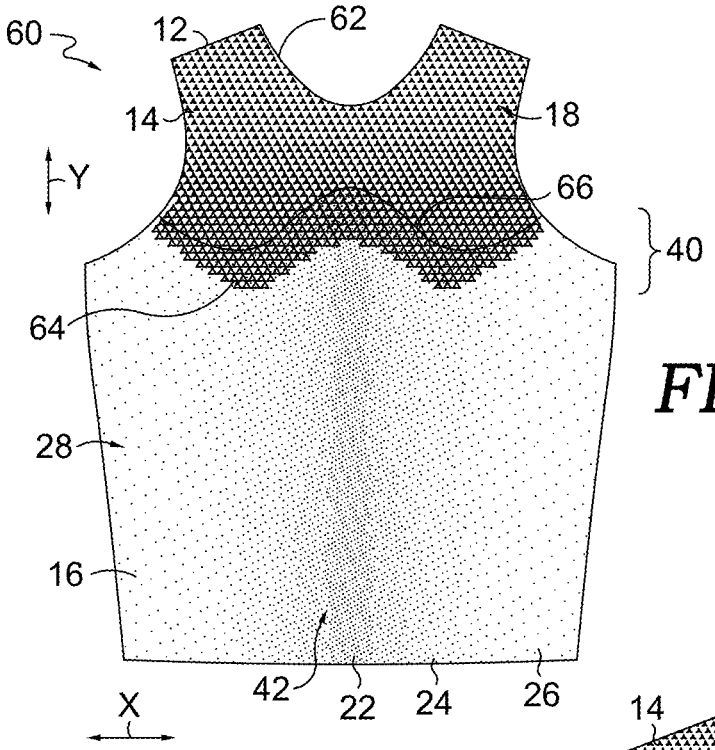
FIG. 5 illustrates an exemplary garment body front having integrated standoff and airflow zones, in accordance with aspects herein.

FIG. 5 further provides a detailed view of the exemplary standoff and airflow zones of the garment body front 60 of the garment body 12 illustrated in FIG. 1. As shown in FIG. 5, the garment body front 60 includes a standoff zone 14 with a plurality of standoff structures creating standoff nodes on the interior face. As further depicted in FIG. 5, an airflow zone 16 includes a plurality of apertures and overlaps with a portion of the standoff zone 14 to create the front overlap zone 40. The upper boundary 66 of the airflow zone 16 indicates an upper limit to where the overlap zone 40 includes both characteristics of the standoff zone 14 and the airflow zone 16, while the lower boundary 64 of the standoff zone 14 indicates a lower limit of the front overlap zone 40. As such, between the lower boundary 64 and the upper boundary 66, the garment body 12 may provide both increased ventilation and comfort to a wearer based on the material standoff between the wearer's skin, and based on increased airflow resulting from a combination of both missed-stitch structures (for creating standoff nodes) and transfer stitch structures (for creating apertures).

Figure 6:
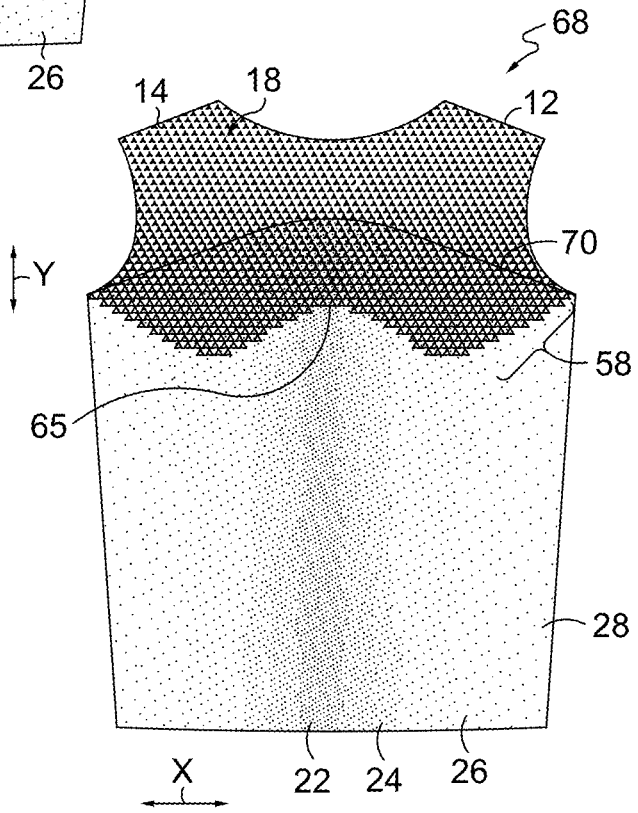
FIG. 6 illustrates an exemplary garment body back having integrated standoff and airflow zones, in accordance with aspects herein.
Figure 13:
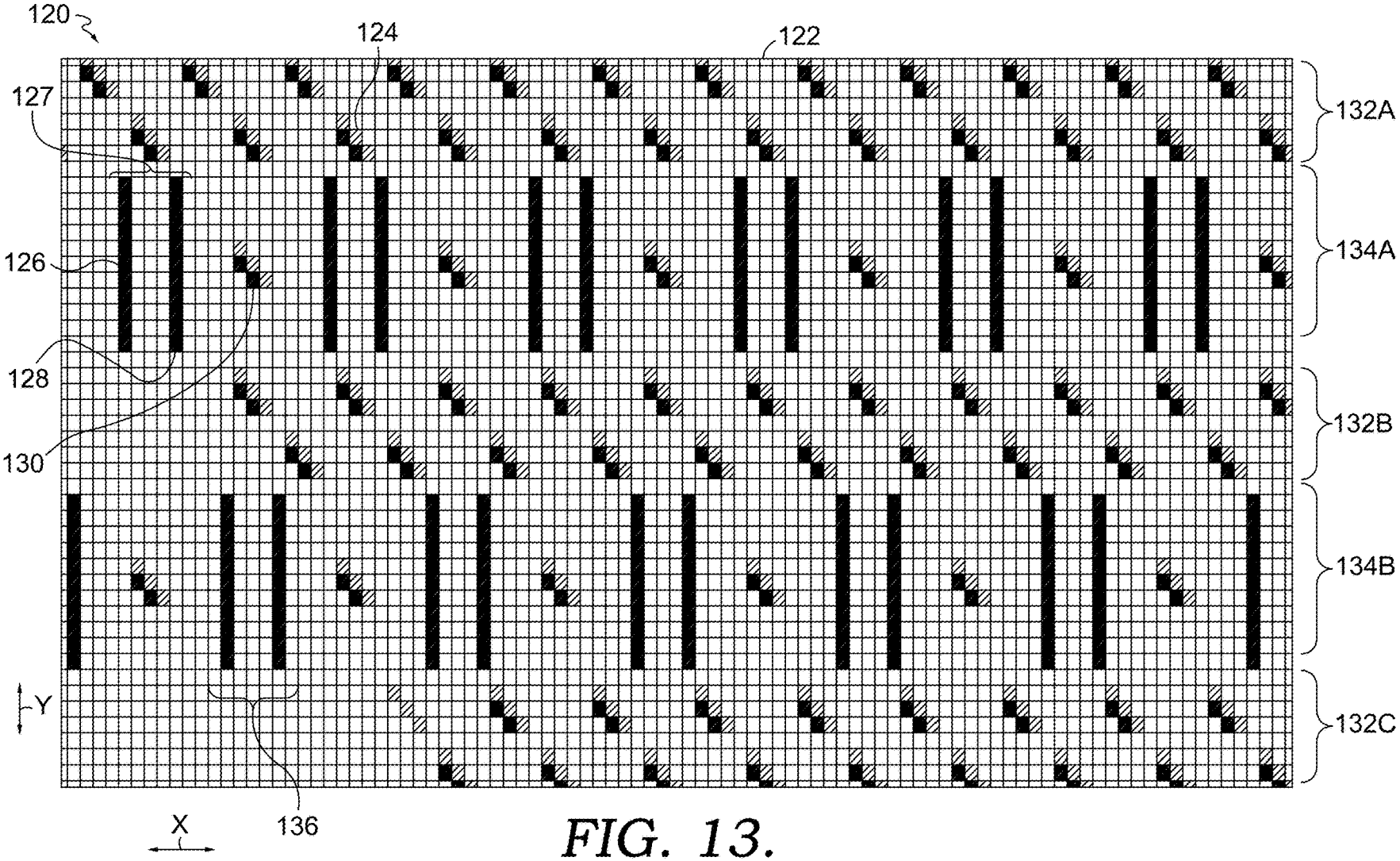
FIG. 13 illustrates an exemplary stitch diagram, in accordance with aspects herein.

The standoff zone 14 (including the portion within the front overlap zone 40) includes one or more standoff densities. The standoff density is the amount of standoff per an area of the garment. The standoff density 18 of the standoff zone 14 may be a uniform density or, in some aspects, may vary. A greater standoff density may be achieved by either a greater degree of separation created by each standoff node, by a greater number of standoff nodes, or by a combination of both. In some aspects, the standoff density 18 is a gradient extending from a standoff upper boundary 62 near superior aspects of the standoff zone 14 to the standoff lower boundary 64 near inferior aspects of the standoff zone 14. This density gradient may be achieved by varying the size of the standoff structure (based on the number of missed needles) and/or the spacing of the standoff structures relative to the apertures. In one example, a gradient standoff zone 14 may include a 10-needle miss between apertures in each row of features in a portion of the overlap zone 40 such that the standoff nodes and apertures alternate in each row, and in another portion, rows with a six-needle miss between apertures alternate with rows of only apertures, creating a lower standoff density. In yet another portion, rows with a four-needle miss between apertures may alternate with rows of only apertures. In a further aspect, as depicted in FIG. 13, a knit-textile panel may include a row of nodes formed with a series of one-needle misses between apertures, alternating with a row of apertures without any nodes. In some aspects, the standoff density at the gradient lower end 64 may be greater than the standoff density at the gradient upper end 62. In this way, when applied to a wearer, the garment body front 60 may have an increased amount of standoff from the wearer's skin proximate the gradient lower end 64, while having a decreased amount of standoff from the wearer's skin proximate the gradient upper end 62, in some aspects. Similarly, as discussed with respect to FIG. 1, the airflow zone 16 may include variable aperture density to provide different levels of ventilation. The garment body back 68 of FIG. 6 depicts similar features as those discussed with respect to the garment body front 60 of FIG. 5. In particular, a back overlap zone 58 is defined by an airflow upper boundary 70 and a standoff lower boundary 65 and includes characteristics of both the standoff zone 14 and the airflow zone 16.

Figure 4:
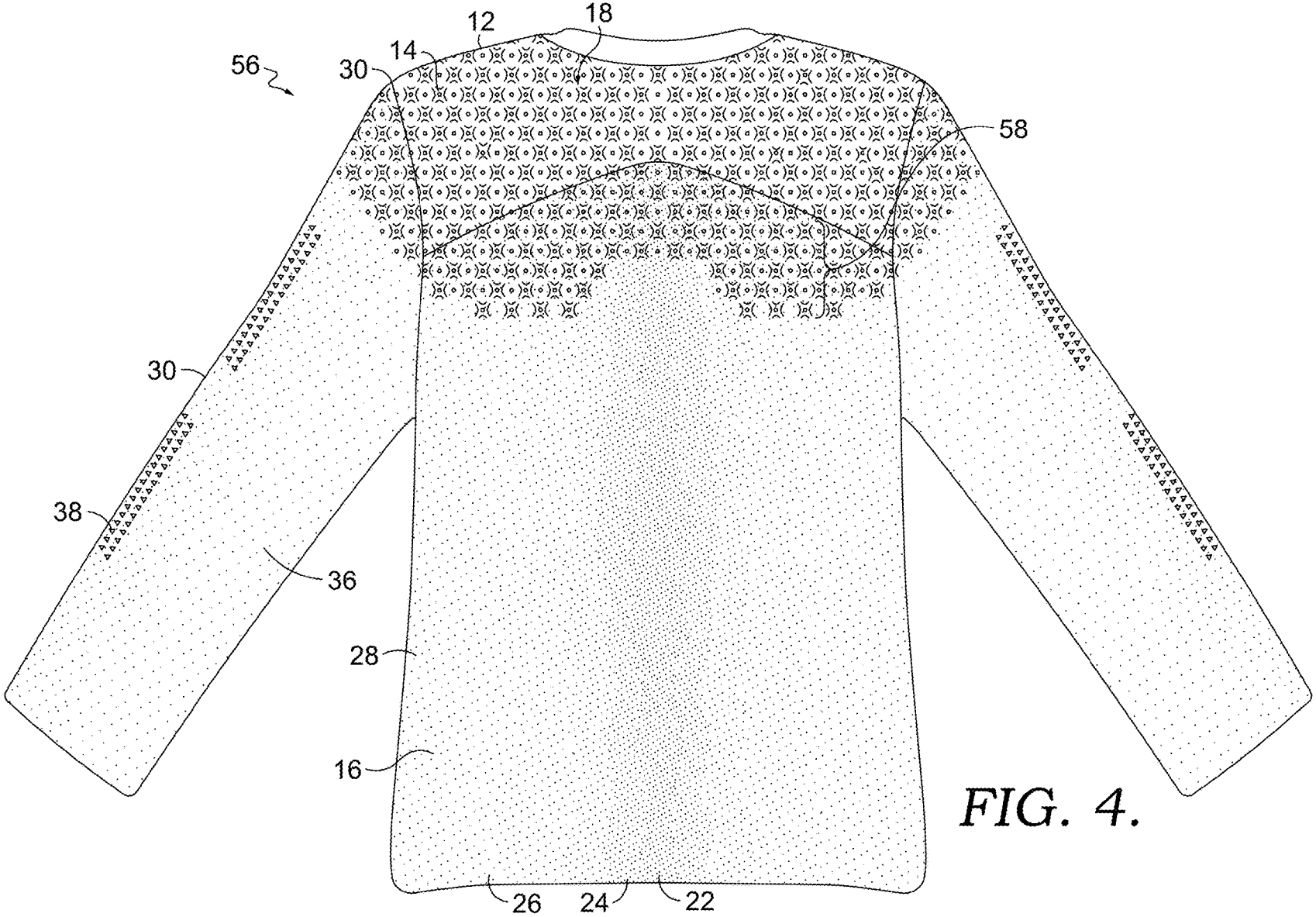
FIG. 4 illustrates a back view of the exemplary garment of FIG. 1, having integrated standoff and airflow zones, in accordance with aspects herein.

Turning next to FIG. 4 which depicts the back view 56 of garment 10, at least one standoff zone 14 may be positioned adjacent to and/or overlapping with the airflow zone 16 within the garment body 12 and/or sleeve 30. As further depicted in FIG. 4, a back overlap zone 58 may be created by integrating a portion of the standoff zone 14 with a portion of the airflow zone 16, providing both ventilation and separation, in accordance with aspects herein. Additionally, although the standoff zone 14 is depicted with the standoff structures being evenly spaced apart to create a single, uniform standoff density 18, the standoff structures may be arranged within the integrated standoff zone 14 to create a non-uniform standoff density by adjusting the number and placement of the missed-stitch structures. For example, the standoff structures may be positioned to provide, a gradient standoff density, a tapered standoff density, or an interrupted standoff density to create zones with varying airflow and venting features. The density of apertures may vary across the back of the garment body 12 and sleeve 30 in a similar manner described with respect to the front view of FIG. 1; however, it is contemplated that a uniform aperture density may also be used.

In some instances, a position of the airflow zone 16 and/or standoff zone 14 within the garment body 12 may vary between a garment front and a garment back. Accordingly, while a similar aperture density gradient is illustrated on both front and back portions of the garment body 12, in some instances, the densities and/or positions of the apertures on the front and/or back sections may be different depending on desired amount of airflow. Similarly, a size, position, and/or proportion of an overlap zone featuring both standoff structures and airflow apertures may be different between the front and back sections based on a desired position of such overlap zone on a wearer, a desired function of the final garment, and/or desired material performance within such overlapping zone.

With reference now to the exemplary stitch diagram 120 in FIG. 13, the sample stitch structure 122 for a standoff region of an upper torso garment, such as the garment 10, depicts an example of circular knitting across each row, along the X-axis, as the material advances along the Y-axis. In this example, a variety of missed-stitch structures and transfer-stitch structures are provided to describe a position within one exemplary pattern of multiple standoff structures, nodes, and apertures. As previously explained with respect to FIGS. 2-3, each row of features on the garment may have a 1:1 ratio of standoff nodes and airflow apertures. The stitch diagram 120 in FIG. 13, however, depicts a different configuration used in at least a portion of the overlap zone in some aspects of the disclosure. As shown in FIG. 13, there are some rows in zones 134A-B that alternate between standoff structures 127 (formed by pairs of missed-stitched structures such as 126 and 128) and apertures (formed by transfer stitch structures 124) to achieve the 1:1 ratio. As illustrated, these rows may be staggered such that the missed-stitched structures in the zone 134A are offset from the missed-stitched structures in the zone 134B. There may be other rows in zones 132A-C, however, with only transfer-stitch structures 124 to form apertures. Each zone 132A-C may include multiple rows of transfer stitches that are offset from one another to again create a staggered orientation. As previously described, a standoff structure may be constructed from one or more miss stitches with a resulting float, and in FIG. 13, the missed-stitch structures 126 and 128 indicate a one-needle miss. However, a similar knit structure of alternating standoff structures and apertures may also be formed with missed-stitch structures that include a greater number of missed needles (e.g., two or more).

Returning to the garment 10 of FIGS. 1 and 4, as previously indicated, the garment 10 includes sleeves such as sleeve 30 with one or more apertures or standoff features. The sleeve 30 may include, in some aspects, a plurality of apertures formed by transfer stitches. Similar to the apertures in the garment body 12, the sleeve 30 may have different densities of apertures. The aperture densities may form a gradient airflow zone between a higher aperture density region 34 located medially on the sleeve 30 (e.g., areas configured to cover a wearer's underarm and triceps area) and a lower aperture density region 36 located more laterally on the sleeve 30. In some aspects, the higher aperture density region 34 and the lower aperture density region 36 both extend along a length of the sleeve 30.

Figure 7:
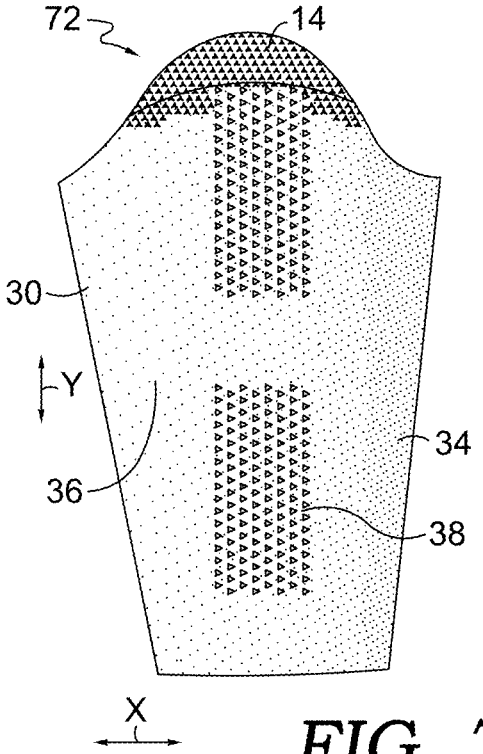
FIG. 7 illustrates an exemplary garment sleeve having integrated standoff and airflow zones, in accordance with aspects herein.

As further shown in FIG. 1, the sleeve 30 may include at least a portion of a standoff zone 14 proximate one or more ends of the sleeve 30, such as an upper shoulder portion of the sleeve 30. In some aspects, the standoff zone 14 includes a plurality of standoff structures that create standoff nodes. These standoff nodes may be created on the internal surface of the garment as described with respect to the garment body 12. The internal standoff nodes may be positioned in the upper shoulder portion of the sleeve 30. However, in some aspects, one or more missed-stitch structures may be used to create outer surface standoff features, such as the outer surface standoff features 38. Exemplary standoff features 38 may provide an aerodynamic characteristic to an external portion or outer-facing surface of the sleeve 30. Turning briefly to FIG. 7, the garment sleeve 72 includes a detailed view of a standoff zone 14 (i.e., internal node structure), a higher-density aperture zone 34, a lower-density aperture zone 36, and an external-node standoff zone 38. Alternative arrangements of such zones within the garment sleeve 72 are contemplated to be within the scope of the disclosure.

As shown in FIG. 1, the sleeve 30 of upper-torso garment 10 is coupled to the garment body 12 at a shoulder seam 32. The position of the shoulder seam 32 may different than what is illustrated in FIGS. 1 and 4. For example, the shoulder seam 32 may be positioned closer to or away from the neckline of the garment body 12. Therefore, an exemplary garment such as a raglan-sleeve top or a set-in sleeve top, with alternative locations for seaming between the garment body 12 and the sleeve 30 is contemplated herein without departing from the scope of the present disclosure.

Additionally, the sleeve 30 may be a discrete arm and/or shoulder sleeve not directly secured to a torso-covering garment.

Other Aspects Including Integrally Knit Structures

Figure 8:
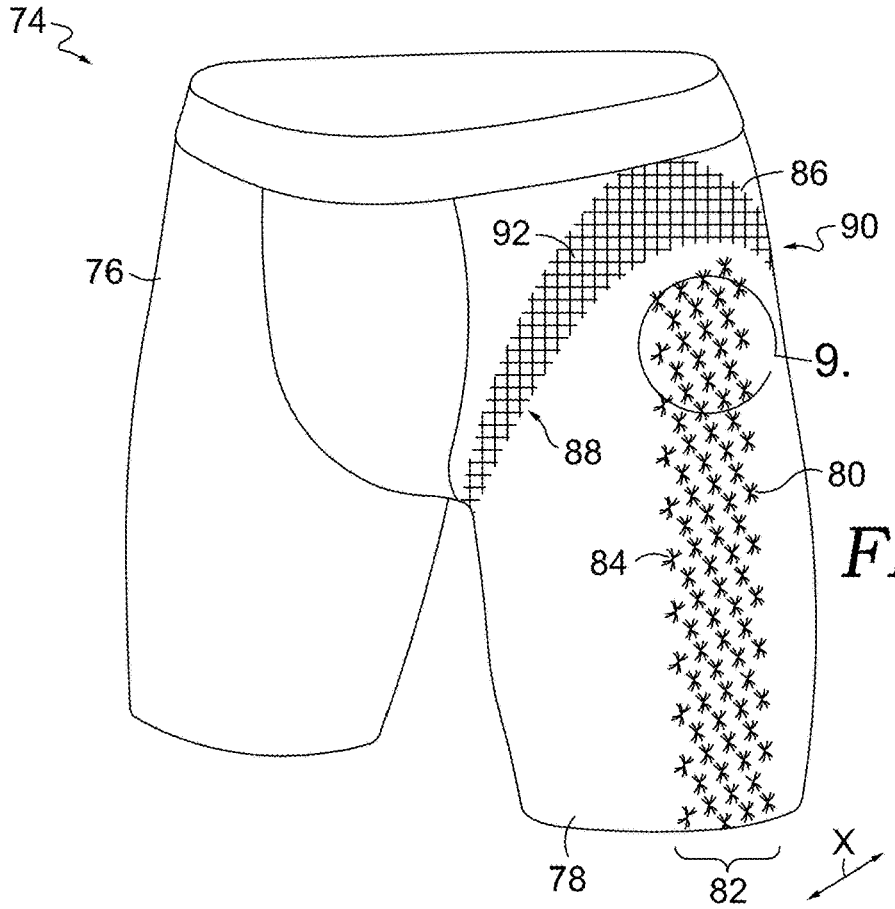
FIG. 8 illustrates an exemplary lower-torso garment having integrated standoff and airflow zones, in accordance with aspects herein.

Turning next to FIG. 8, an exemplary lower-torso garment 74 includes a half-tight 76 with a leg 78. The leg includes a zone 80 that is constructed to include a plurality of integrally knit structures 84, and the zone spans a width 82 on the leg 78. In one aspect, the position of the zone 80 and the width of the band 82 are configured to interface with a boundary layer (e.g., of ambient air) when the lower-torso garment 74 is in an in-use configuration, donned by a wearer and when the wearer is in motion (e.g., running). That is, when the lower-torso garment is donned by a wearer in an in-use configuration and the wearer is in motion, such as by running, then the zone 80 is positioned to interface with a boundary layer of air passing over the surface of the knit textile panel.

In a further aspect, the integrally knit structures 84 comprise an integrally knit protuberance that extends outward and away from the wearer, such that the integrally knit structure 84 engages with (e.g., disrupts) the boundary layer in order to affect the aerodynamics of the knit textile surface. The integrally knit structure 84 including the protuberance may be constructed in various manners, such as with a series of missed-stitch structures with floats creating a puckered effect on an exterior of the half-tight 76. In some aspects, the half-tight 76 includes a mobility region 86 that spans between a front region 88 and a back region 90 of the leg 78. In some aspects, the mobility region 86 includes a mesh structure 92 that is integral to the circular-knit garment 74.

Figure 9:
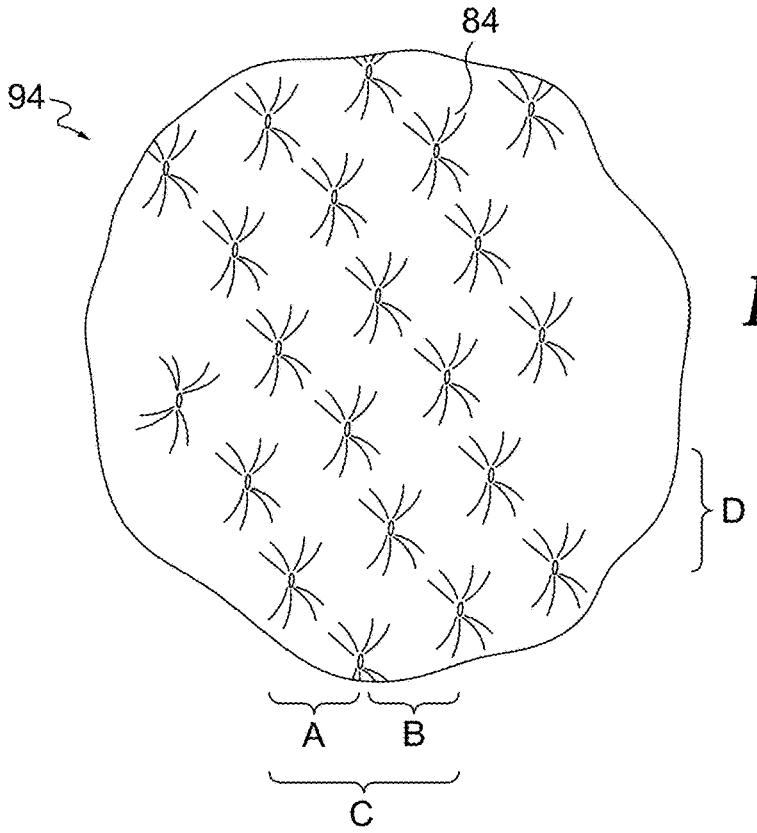
FIG. 9 illustrates an enlarged, front view of a portion of the integrated standoff zone of FIG. 8, in accordance with aspects herein.

The enlarged view 94 in FIG. 9 depicts the integrated missed-stitch structures 84 on an external portion of the leg 78, creating a protuberance configured to affect the aerodynamics of the lower-torso garment by engaging with a boundary layer when the lower-torso garment is donned by a wearer in motion. In some aspects, the series of missed-stitch structures 84 may be staggered between a first spacing A and a second spacing B across a width C, and staggered further along the leg 78 according to spacing D.

Figure 14:
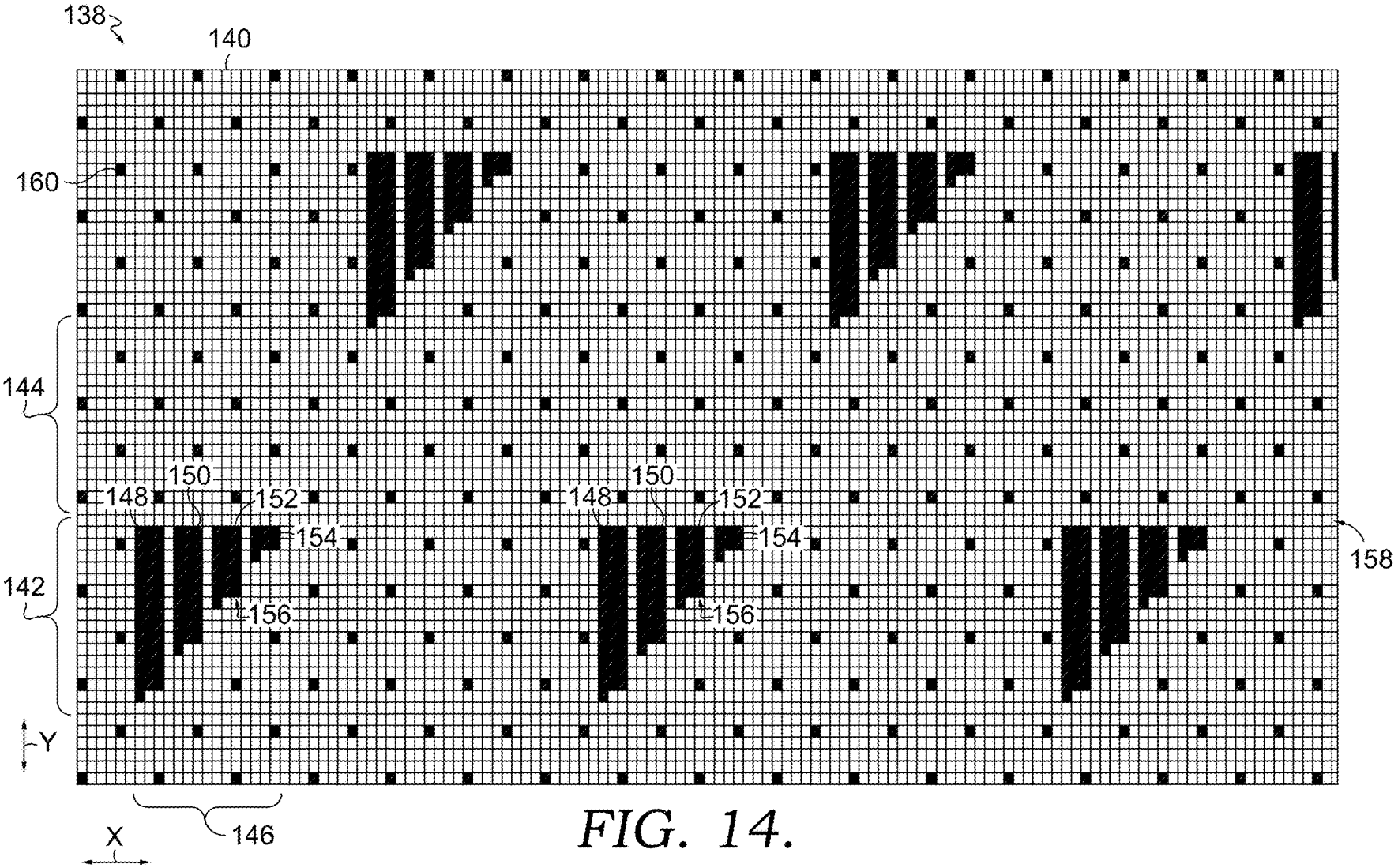
FIG. 14 illustrates an exemplary stitch diagram, in accordance with aspects herein.

Referring to the exemplary stitch diagram 138 of FIG. 14, a sample stitch diagram 140 for a region of a lower torso garment depicts an example of circular knitting across each row, along the x axis, as the material advances along the y axis. In this example, a variety of missed-stitch structures and pique-knit structures are provided to describe a position within a dimensional tight leg, such as the missed-stitch structures on the outer surface of FIG. 8. In one example, the missed-stitch zone 142 alternates with portions of a staggered pique zone 144 (with one or more pique stitches 160) along the y axis to provide a supportive, aerodynamic material 158. In some aspects, the stitch structure 140 includes a gradient missed-stitch structure 146 having a first portion 148, a second portion 150, a third portion 152, and a fourth portion 154. In some aspects, a height of the first, second, third, and fourth portions 148, 150, 152, and 154 shifts along a tapered edge 156 to generate a resulting ruching effect on an external surface of material, such as the half-tight material of FIG. 8.

In other aspects, a variety of different materials and yarn combinations may be used to vary the resulting fabric feel, dimension, properties, structure, appearance, and the like. As such, in one aspect a knit textile constructing at least part of the lower-torso garment may include a poly flat CD 50/24 yarn on a face side, with a covered elastic yarn 20/30/18 on a back side. In some aspects, a proportion of denier, filament, ply, and/or elastic yarn content may be changed to adjust one or more characteristics of the garment material. For example, a yarn combination may be adjusted between airflow zones and standoff zones, and may further be altered within such zones, to provide a desired amount of standoff, ventilation, and other engineered characteristics within the zonal features of the circular-knit material.

Figure 10:
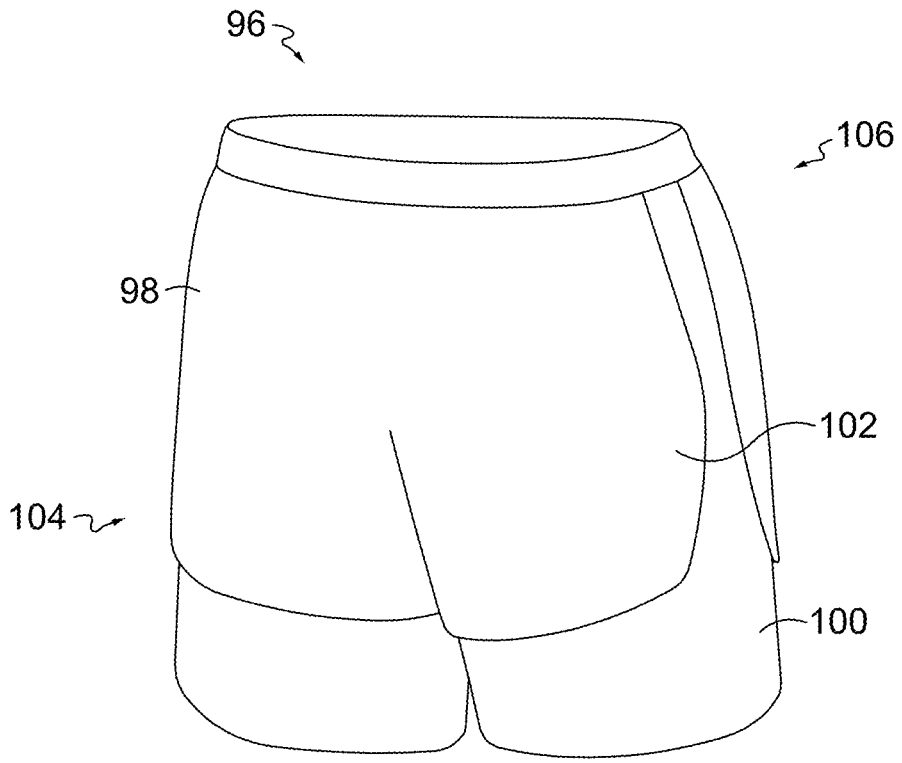
FIG. 10 illustrates an exemplary garment having integrated zones, in accordance with aspects herein.

Referring now to FIG. 10, a hybrid short 96 is depicted. Further aspects of the circular-knit garments, including integrated standoff zones, integrated airflow zones, missed-stitch standoff features, transfer-stitch apertures, and the like, may be included in one or more portions of the hybrid short 96 of FIG. 10, having features of one or more garments depicted herein. Additionally, as shown in the example of FIG. 10, the hybrid shorts 96 may include a shorts body 98 having a half-tight 100 underneath the front and back modesty panels 102, with a front region 104 opposite a back region 106 of the hybrid shorts 96. In some aspects, the hybrid shorts 96 may include the aerodynamic ruching effects of the missed-stitch structures of FIG. 8. In other aspects, one or more mobility regions 86 may be incorporated into the half-tight 100 and/or modesty panels 102, according to some examples.

Figure 11:
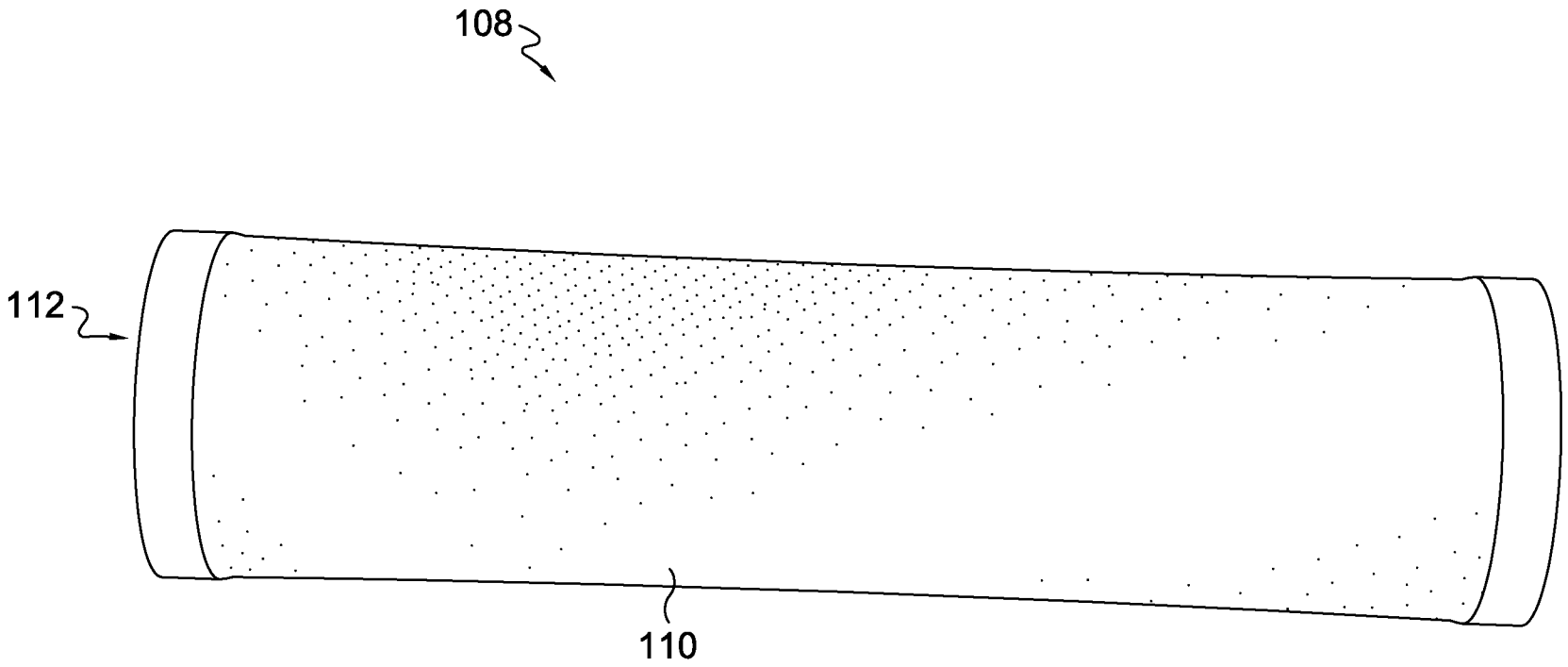
FIG. 11 illustrates a side view of an exemplary sleeve garment having integrated standoff and airflow zones, in accordance with aspects herein.
Figure 12:
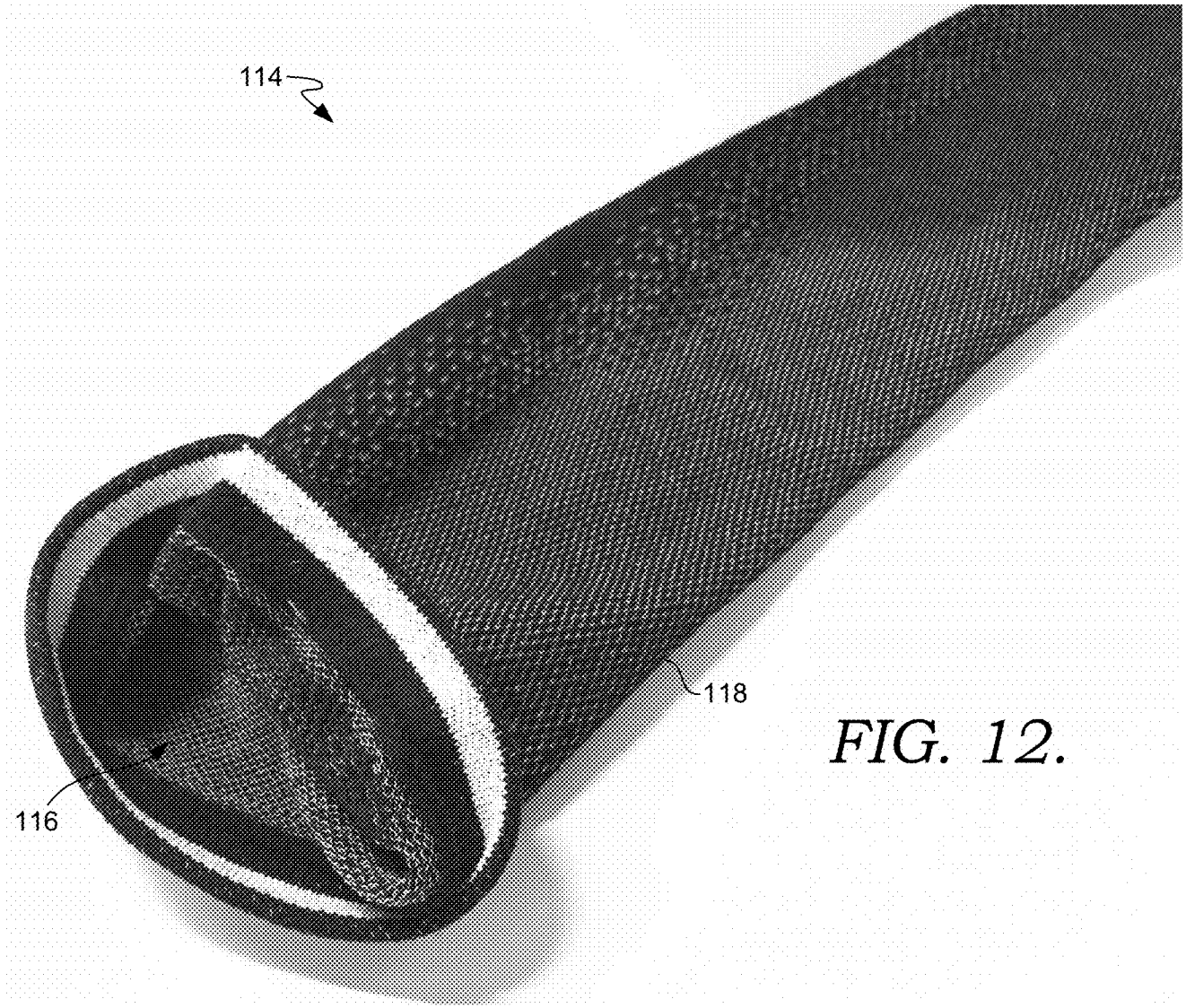
FIG. 12 illustrates a perspective view of the exemplary sleeve garment of FIG. 11, in accordance with aspects herein.

Turning next to FIG. 11, a side view 108 of an exemplary arm sleeve 110 having airflow zones is provided in accordance with aspects herein. In the example of FIG. 11, a gradient structure may be knitted into the arm sleeve 110, such as transfer-stitch apertures, a mesh jersey structure, or other structures knitted into the arm sleeve 110 to provide a desired amount of air permeability and/or breathability during wear. In further aspects, as shown in the perspective view 114 of FIG. 12, the arm sleeve 110 may include a first sleeve yarn content 116 that varies from a surrounding sleeve yarn content 118, such as a gripping yarn associated with the sleeve yarn content 116 near an opening of the arm sleeve 110, such as a wrist or armhole. As used throughout this disclosure, the term "gripping yarn" means a yarn that exhibits a high coefficient of friction. Exemplary gripping yarns may comprise rubber yarns, and yarns that have a higher number of filaments within a single yarn strand. For instance, a single polyester yarn strand may comprise up to 7000 or greater number of filaments such that the denier per filament of the single yarn strand is less than or equal to 0.01. The large number of filaments provides a large surface-to-volume ratio for the single yarn strand which contributes to the gripping function of the yarn. Similarly, such first sleeve yarn content 116 with gripping characteristics may be integrated within the surrounding sleeve yarn content 118 at alternative positions, such as a first sleeve yarn content 116 positioned near a bicep of a wearer of the arm sleeve 110.

As explained above, the arm sleeve 110 is described in one aspect to include a combination of features, including integrally knit apertures that provide air permeability and breathability during wear, as well as gripping yarns in select locations. In some other aspects, a knit arm sleeve is not limited to these features and may include additional features, such as nodes that provide standoff on an inside surface of the sleeve and/or protuberances extending from an outside surface.

Having described various aspects illustrated in FIGS. 1-17, as well as alternative aspects, some additional aspects will now be described that may related to on one or more of the illustrated, or alternative aspects. For example, in one aspect a garment is constructed of a knit material, the material constructed with at least one airflow zone and at least one standoff zone. In some aspects, the at least one airflow zone comprises a plurality of knitted apertures in the knit material. Further, the at least one standoff zone comprises a plurality of knitted nodes in the knit material.

Aspects herein further provide for a knit garment comprising at least one of a first standoff zone and a first airflow zone. In aspects, the first standoff zone comprises: a plurality of knitted stitches in a first standoff zone material; a plurality of missed-stitch segments with resulting floats adjacent the plurality of knitted stitches; and a plurality of nodes proximate the plurality of missed-stitch segments and displaced a distance from a fabric back of the first standoff zone material. Further, the first airflow zone comprises: a plurality of knitted stitches in a first airflow zone material; and a plurality of transferred stitches adjacent the plurality of knitted stitches, said plurality of transferred stitches forming a first plurality of apertures, wherein each of the first standoff zone and the first airflow zone comprises at least one contiguous yarn.

Another aspect provides for a method of forming a circular-knit garment having at least one integrated standoff zone. The method comprises knitting a material having at least one integrated standoff zone, said at least one integrated standoff zone comprising a plurality of missed-stitch structures providing a missed-stitch first textile surface and a missed-stitch second textile surface opposite the first textile surface, said plurality of missed-stitch structures comprising at least one fabric gather proximate each of the plurality of missed-stitch structures on one or more of the first textile surface and the second textile surface. The method further comprises forming the circular-knit garment using the material.

An additional aspect of the present disclosure includes an integrally knit node, which is constructed of a plurality of stitches within a knit-textile panel. The stitches are arranged in a series of consecutive partial courses arranged adjacently, one after the next. A partial course refers to a series of consecutive stitches that are arranged side-by-side at consecutive stitch positions and that are included as part of a longer course of stitches. In one aspect the number of partial courses in the series of consecutive courses in a range of about 4 courses to about 20 courses, and in another aspect, the number of courses in the series is in a range of about 8 courses to about 12 courses. Each course includes a sequence of stitches that includes a first knit stitch, a float traversing a number of stitch positions, and a second knit stitch. In one aspect, the number of stitch positions traversed by the float is in a range of 1 stitch position to about 20 stitch positions, and in a further aspect, the number of stitch positions traversed by the float is in a range of 1 stitch position to about 11 stitch positions. In a further aspect, the series of consecutive courses is a first series of consecutive courses, and the node includes a second series of consecutive partial courses that are arranged in a same set of courses as the first series. The second series and the first series are spaced apart by at least one wale of stitches and may be spaced apart by at least up to eight wales. The second series also includes a sequence of stitches including a first knit stitch, a float traversing a number of stitch positions, and a second knit stitch. The float of the second series may have a length that is the same as the float of the first series. And in an alternative aspect, the float in the first series may have a different length (i.e., number of stitch positions traversed) than the float in the second series. In a further aspect, the node includes a relatively non-elastic yarn on the face side of the knit-textile panel and a relatively elastic yarn on the back side of the knit-textile panel. In one aspect, the elastic yarn may be knit into less than every course. For example, the elastic yarn may be knit into every other course, every third course, or every fourth course.

Another aspect of the disclosure is a method of manufacturing a knit article. The method comprises knitting a first knit course having a knit sequence. The knit sequence is created by forming a first set of knit stitches forming a float stitch by deactivating a number of needles after the first set of knit stitches, and forming a second set of knit stitches after the float stitch. The method further includes knitting one or more additional knit courses each having the knit sequence, wherein the first set of knit stitches, the float stitch, and the second set of knit stitches for each knit course are aligned with each other, wherein the first knit course and the one or more additional knit courses are consecutive courses. In some aspects, the one or more additional knit courses comprises a number of knit courses in a range of 2 to 20 and, further, in some embodiments, the range is between 4 and 12.

In some aspects, the knit sequence is further created by forming a second float stitch by deactivating a second number of needles after the second set of knit stitches; and forming a third set of knit stitches after the second float stitch. The first number of needles and the second number of needles may each be are within a range of 1 to 14. In some aspects, first number of needles and the second number of needles are the same number such that the first and second float stitches have the same length. In alternative aspects, the first number of needles and the second number of needles are different. Additionally, in some aspects, the one or more knit courses may be formed with an elastic yarn, and in further aspects at least one knit course is formed with an elastic yarn forming one face of the knit article and a non-elastic yarn forming an opposite face of the knit article. In one aspect, the elastic yarn may be knit into every fourth course. Further, in some aspects, the knit sequence is further created by forming a transfer stitch to create an aperture after the third set of knit stitches. In some embodiments, additional transfer stitches are formed to create a plurality of apertures.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A garment comprising:

a knit material, the knit material constructed with at least one airflow zone and at least one standoff zone, wherein the at least one airflow zone comprises a plurality of knitted apertures in the knit material, and further wherein the at least one standoff zone comprises a plurality of knitted nodes in the knit material, the plurality of knitted nodes comprising:

a first knitted node formed from a first missed-stitch structure comprising a first set of float stitches in a first set of wales extending across a first plurality of courses, a second missed-stitch structure comprising a second set of float stitches in a second set of wales extending across the first plurality of courses, and knitted material between the first set of float stitches and the second set of float stitches, and a second knitted node formed from a third missed-stitch structure comprising a third set of float stitches in a second plurality of courses, a fourth missed-stitch structure comprising a fourth set of float stitches in the second plurality of courses, and knitted material between the third set of float stitches and the fourth set of float stitches, wherein the first plurality of courses is separated from the second plurality of courses by a third plurality of courses having a set of knitted stitches within at least the first set of wales.

2. The garment of claim 1, wherein the knit material comprises at least one stretch yarn knitted into at least a portion of the knit material.

3. The garment of claim 2, wherein the at least one stretch yarn comprises an elastic yarn type.

4. The garment of claim 1, wherein each of the plurality of knitted apertures of the at least one airflow zone comprises at least one transfer stitch in seamless construction with the surrounding knit material.

5. The garment of claim 1, wherein the first set of float stitches and the second set of float stitches are formed along a back side of the knit material and wherein each knitted node protrudes from the back side.

6. The garment of claim 1, wherein the at least one airflow zone comprises a first airflow zone and a second airflow zone, each airflow zone oriented along a vertical axis of the garment, wherein the knit material further comprises a first blended zone between the first airflow zone and the second airflow zone.

7. The garment of claim 1, wherein the first knitted node is offset from the second knitted node in a staggered orientation along a horizontal axis of knitting.

8. The garment of claim 7, wherein the knit material comprises at least one overlap zone comprising at least a portion of at least one airflow zone and at least a portion of at least one standoff zone.

9. A knit garment comprising at least one of a first standoff zone and a first airflow zone, wherein the first standoff zone comprises:

a plurality of knitted stitches in a first standoff zone material;

a plurality of missed-stitch segments adjacent the plurality of knitted stitches; and a plurality of nodes formed by the plurality of missed-stitch segments and displaced a threshold distance from a fabric back of the first standoff zone material, the plurality of nodes comprising:

a first knitted node formed from a first missed-stitch segment comprising a first set of float stitches in a first set of wales extending across a first plurality of courses, a second missed-stitch segment comprising a second set of float stitches in a second set of wales extending across the first plurality of courses, and a first set of knitted stitches within the plurality of knitted stitches in the first standoff zone, the first set of knitted stitches being between the first set of float stitches and the second set of float stitches, and a second knitted node formed from a third missed-stitch segment comprising a third set of float stitches in a second plurality of courses, a fourth missed-stitch segment comprising a fourth set of float stitches in the second plurality of courses, and a second set of knitted stitches from the plurality of knitted stitches in the first standoff zone, the second set of knitted stitches being between the third set of float stitches and the fourth set of float stitches, wherein the first plurality of courses is separated from the second plurality of courses by a third plurality of courses having a third set of knitted stitches within at least the first set of wales in the first standoff zone; and further wherein the first airflow zone comprises:

a plurality of knitted stitches in a first airflow zone material; and a plurality of transferred stitches adjacent the plurality of knitted stitches of the first airflow zone, the plurality of transferred stitches forming a first plurality of apertures, wherein each of the first standoff zone and the first airflow zone comprises at least one contiguous yarn.

10. The knit garment of claim 9, wherein the first knitted node is within a first row of nodes of the plurality of nodes and the second knitted node is within a second row of nodes of the plurality of nodes, wherein the first row of nodes is in a staggered orientation with respect to the second row of nodes.

11. The knit garment of claim 9, wherein at least one transferred stitch of a first row of the plurality of transferred stitches is in a staggered orientation with respect to at least one other transferred stitch of a second row of the plurality of transferred stitches.

12. The knit garment of claim 9, further comprising:

a second airflow zone proximate the first airflow zone, said second airflow zone comprising:

a plurality of knitted stitches in a second airflow zone material; and a plurality of transferred stitches adjacent the plurality of knitted stitches of the second airflow zone, the plurality of transferred stitches forming a second plurality of apertures, wherein the first plurality of apertures of the first airflow zone comprises a first density and the second plurality of apertures of the second airflow zone comprises a second density different than said first density; and a blended zone between at least a portion of the first airflow zone and at least a portion of the second airflow zone.

13. The knit garment of claim 9, further comprising an overlap zone comprising at least a portion of the first standoff zone and at least a portion of the first airflow zone.

14. A method of manufacturing a knit article, the method comprising:

knitting a first knitted node along a first plurality of courses, wherein knitting the first knitted node comprises:

knitting a first knit course within the first plurality of courses having a knit sequence, wherein the knit sequence is created by:

forming a first set of knit stitches, forming a first float stitch across a first set of wales by deactivating a first number of needles after the first set of knit stitches, and forming a second set of knit stitches after the first float stitch, forming a second float stitch across a second set of wales by deactivating a second number of needles after the second set of knit stitches, and forming a third set of knit stitches after the second float stitch; and knitting one or more additional knit courses within the first plurality of courses each having the knit sequence, wherein the first float stitch, the second set of knit stitches, and the second float stitch for each knit course within the first plurality of courses are aligned and create the first knitted node, wherein the first knit course and the one or more additional knit courses are consecutive courses, knitting a second plurality of courses comprising a fourth set of knit stitches within at least the first set of wales; and knitting a second knitted node along a third plurality of courses separated from the first plurality of courses by the second plurality of courses, wherein each course within the third plurality of courses has the knit sequence of the first plurality of courses, wherein the first float stitch, the second set of knit stitches, and the second float stitch for each knit course within the third plurality of courses are aligned and create the second knitted node, wherein knitting at least some courses of the first knit course and the one or more additional knit courses of the first plurality of courses further comprises forming a transfer stitch to create an aperture after the third set of knit stitches within the first plurality of courses.

15. The method of claim 14, wherein the first number of needles and the second number of needles each are within a range of 1 to 14.

16. The method of claim 14, wherein the one or more additional knit courses comprises a number of knit courses in a range of 2 to 20.

17. The method of claim 14, wherein one or more knit courses are formed with an elastic yarn.

* * * * *